US010703595B2

(12) United States Patent
Nishikawa et al.

(10) Patent No.: US 10,703,595 B2
(45) Date of Patent: Jul. 7, 2020

(54) SHEET FEEDING PARAMETER MANAGEMENT SYSTEM

(71) Applicant: KONICA MINOLTA, INC., Chiyoda-ku, Tokyo (JP)

(72) Inventors: Eiji Nishikawa, Tama (JP); Takahiro Yokoya, Tama (JP); Noritaka Shimizu, Nara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/213,011

(22) Filed: Dec. 7, 2018

(65) Prior Publication Data

US 2019/0185280 A1 Jun. 20, 2019

(30) Foreign Application Priority Data

Dec. 18, 2017 (JP) ..... 2017-241305

(51) Int. Cl.
*B65H 7/16* (2006.01)
*B65H 3/14* (2006.01)
(Continued)

(52) U.S. Cl.
CPC ..... *B65H 7/16* (2013.01); *B65H 3/08* (2013.01); *B65H 3/14* (2013.01); *B65H 3/44* (2013.01);
(Continued)

(58) Field of Classification Search
CPC ..... B65H 1/08; B65H 3/08; B65H 3/0808; B65H 3/10; B65H 3/14; B65H 3/44; B65H 3/48; B65H 7/06; B65H 7/12; B65H 7/125; B65H 7/16; B65H 7/20; B65H 2511/52; B65H 2511/524; B65H 2511/528;
(Continued)

(56) References Cited

U.S. PATENT DOCUMENTS

2010/0148425 A1* 6/2010 Kosugi ..... B65H 3/128 271/11
2011/0229237 A1* 9/2011 Hayashi ..... B65H 3/44 400/76
(Continued)

FOREIGN PATENT DOCUMENTS

JP 2008097382 A 4/2008

*Primary Examiner* — Prasad V Gokhale
(74) *Attorney, Agent, or Firm* — Holtz, Holtz & Volek PC

(57) ABSTRACT

A sheet feeding parameter management system includes: a plurality of air sheet feeding apparatuses each including an air sheet feeder that feeds a sheet and enabled to change a sheet feeding parameter; and a management apparatus connected to the plurality of air sheet feeding apparatuses, wherein each of the plurality of air sheet feeding apparatuses includes: a sheet type information acquisitor that acquires sheet type information; and a hardware processor that: adjusts the sheet feeding parameter; and transmits the sheet type information and the sheet feeding parameter to the management apparatus, and the management apparatus includes the hardware processor that: causes a storage to store an adjustment result associated with the sheet type information and the sheet feeding parameter; and sets, based on the adjustment result, for an air sheet feeding apparatus to be processed among the plurality of air sheet feeding apparatuses.

11 Claims, 7 Drawing Sheets

(51) Int. Cl.

| | |
|---|---|
| ***B65H 3/44*** | (2006.01) |
| ***B65H 3/48*** | (2006.01) |
| ***B65H 3/08*** | (2006.01) |
| ***B65H 7/06*** | (2006.01) |
| ***G03G 15/00*** | (2006.01) |
| ***B65H 7/12*** | (2006.01) |

(52) U.S. Cl.
CPC ..... *B65H 3/48* (2013.01); *B65H 7/06* (2013.01); *B65H 7/12* (2013.01); *G03G 15/50* (2013.01); *B65H 2511/416* (2013.01); *B65H 2511/524* (2013.01); *B65H 2511/529* (2013.01); *B65H 2515/212* (2013.01); *B65H 2515/342* (2013.01); *B65H 2551/20* (2013.01); *B65H 2557/12* (2013.01); *B65H 2557/23* (2013.01); *B65H 2557/63* (2013.01); *B65H 2801/06* (2013.01)

(58) Field of Classification Search
CPC ..... B65H 2511/529; B65H 2511/416; B65H 2515/212; B65H 2515/342; B65H 2557/12; B65H 2557/23; B65H 2557/63
USPC ..... 271/9.01, 96
See application file for complete search history.

(56) References Cited

U.S. PATENT DOCUMENTS

| | | | | |
|---|---|---|---|---|
| 2017/0023901 | A1* | 1/2017 | Asakawa | G03G 15/70 |
| 2018/0257886 | A1* | 9/2018 | Tsujita | B65H 1/04 |

* cited by examiner

FIG. 5A

Ta

| SHEET TYPE INFORMATION | SHEET FEEDING PARAMETER | DISTURBANCE INFORMATION |
|---|---|---|
| A0 | E0 | |
| | | |
| B0 | F0 | |
| | | |
| C0 | G0 | |
| | | |
| D0 | H0 | |
| | | |

FIG. 5B

Tb

| SHEET TYPE INFORMATION | SHEET FEEDING PARAMETER | DISTURBANCE INFORMATION |
|---|---|---|
| A0 | E0 | |
| A1 | E1 | 0 |
| B0 | F0 | |
| | | |
| C0 | G0 | |
| | | |
| D0 | H0 | |
| | | |

FIG. 5C

Tc

| SHEET TYPE INFORMATION | SHEET FEEDING PARAMETER | DISTURBANCE INFORMATION |
|---|---|---|
| A0 | E0 | |
| | | |
| B0 | F0 | |
| B1 | F1 | 0 |
| C0 | G0 | |
| | | |
| D0 | H0 | |
| | | |

FIG. 5D

Td

| SHEET TYPE INFORMATION | SHEET FEEDING PARAMETER | DISTURBANCE INFORMATION |
|---|---|---|
| A0 | E0 | |
| A1 | E2 | V1 |
| B0 | F0 | |
| B1 | F2 | 0 |
| C0 | G0 | |
| | | |
| D0 | H0 | |
| | | |

FIG. 6A

T1

| SHEET TYPE INFORMATION | SHEET FEEDING PARAMETER | MODEL INFORMATION |
|---|---|---|
| A0 | E0 | |
| A1 | E1 | 10B |
| B0 | F0 | |
| B1 | F3 | 10C, 10D |
| C0 | G0 | |
| | | |
| D0 | H0 | |
| | | |

FIG. 6B

T2

| SHEET TYPE INFORMATION | DISTURBANCE INFORMATION | SHEET FEEDING PARAMETER DIFFERENCE | MODEL INFORMATION |
|---|---|---|---|
| A1 | V1 | $\Delta W1 = E2-E1$ | 10D |
| | | | |
| | | | |
| | | | |
| | | | |
| | | | |
| | | | |
| | | | |

SHEET FEEDING PARAMETER MANAGEMENT SYSTEM

The entire disclosure of Japanese patent Application No. 2017-241305, filed on Dec. 18, 2017, is incorporated herein by reference in its entirety.

BACKGROUND

Technological Field

The present invention relates to a sheet feeding parameter management system.

Description of the Related Art

Conventionally, an air suction type sheet feeding apparatus (hereinafter referred to as an air sheet feeding apparatus) is known as a sheet feeding apparatus that feeds a sheet to an image forming apparatus. In the air sheet feeding apparatus, a sheet is separated from a stacked sheet bundle by air blowing from its side surface, and the uppermost sheet is suctioned and conveyed, whereby the sheets are fed out one by one. In the air sheet feeding apparatus, an optimum sheet feeding condition (sheet feeding parameter) is set depending on a sheet type.

In the image forming apparatus, various control parameters are used. For example, a technique is devised in which, in a host apparatus connected to an image forming apparatus, a parameter for controlling the fixing process is determined based on state information including the type of the sheet sent from the image forming apparatus and the temperature of the fixer, and is transmitted to the image forming apparatus (see JP 2008-97382 A).

However, with the air sheet feeding apparatus, it is difficult to prepare in advance optimum sheet feeding conditions for various sheet types. For that reason, the sheet feeding apparatus side is provided with an adjuster that adjusts the sheet feeding parameter, but there has been a problem that down time occurs every time a sheet feeding failure occurs. In particular, for air sheet feeding, it is difficult to accurately calculate the sheet feeding parameter, since the optimum parameter is different depending on a subtle difference in a sheet characteristic.

SUMMARY

The present invention has been made in view of the problems in the conventional technique described above, and it is an object to set sheet feeding parameters suitable for various sheet types.

To achieve the abovementioned object, according to an aspect of the present invention, a sheet feeding parameter management system reflecting one aspect of the present invention comprises: a plurality of air sheet feeding apparatuses each including an air sheet feeder that feeds a sheet by air blowing and suctioning to the sheet and enabled to change a sheet feeding parameter in the air sheet feeder; and a management apparatus connected to the plurality of air sheet feeding apparatuses via a communication network, wherein each of the plurality of air sheet feeding apparatuses includes: a sheet type information acquisitor that acquires sheet type information of a sheet to be fed; and a hardware processor that: adjusts the sheet feeding parameter in the air sheet feeder; and transmits the sheet type information acquired by the sheet type information acquisitor and the sheet feeding parameter adjusted by the hardware processor to the management apparatus, and the management apparatus includes the hardware processor that: causes a storage to store an adjustment result associated with the sheet type information and the sheet feeding parameter transmitted from each of the plurality of air sheet feeding apparatuses; and sets, based on the adjustment result stored in the storage, for an air sheet feeding apparatus to be processed among the plurality of air sheet feeding apparatuses, the sheet feeding parameter corresponding to the sheet type information acquired by the sheet type information acquisitor of the air sheet feeding apparatus to be processed.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 5A to 5D are data configuration examples of a sheet feeding parameter table stored in each image forming apparatus;

FIG. 6A is a data configuration example of a within-reference-range table stored in the management apparatus;

FIG. 6B is a data configuration example of a disturbance adjustment table stored in the management apparatus;

DETAILED DESCRIPTION OF EMBODIMENTS

Hereinafter, one or more embodiments of the present invention will be described with reference to the drawings. However, the scope of the invention is not limited to the disclosed embodiments.

First Embodiment

First, a first embodiment will be described of a sheet feeding parameter management system according to the present invention. Note that, the present invention is not limited to the illustrated examples.

Figure 1:
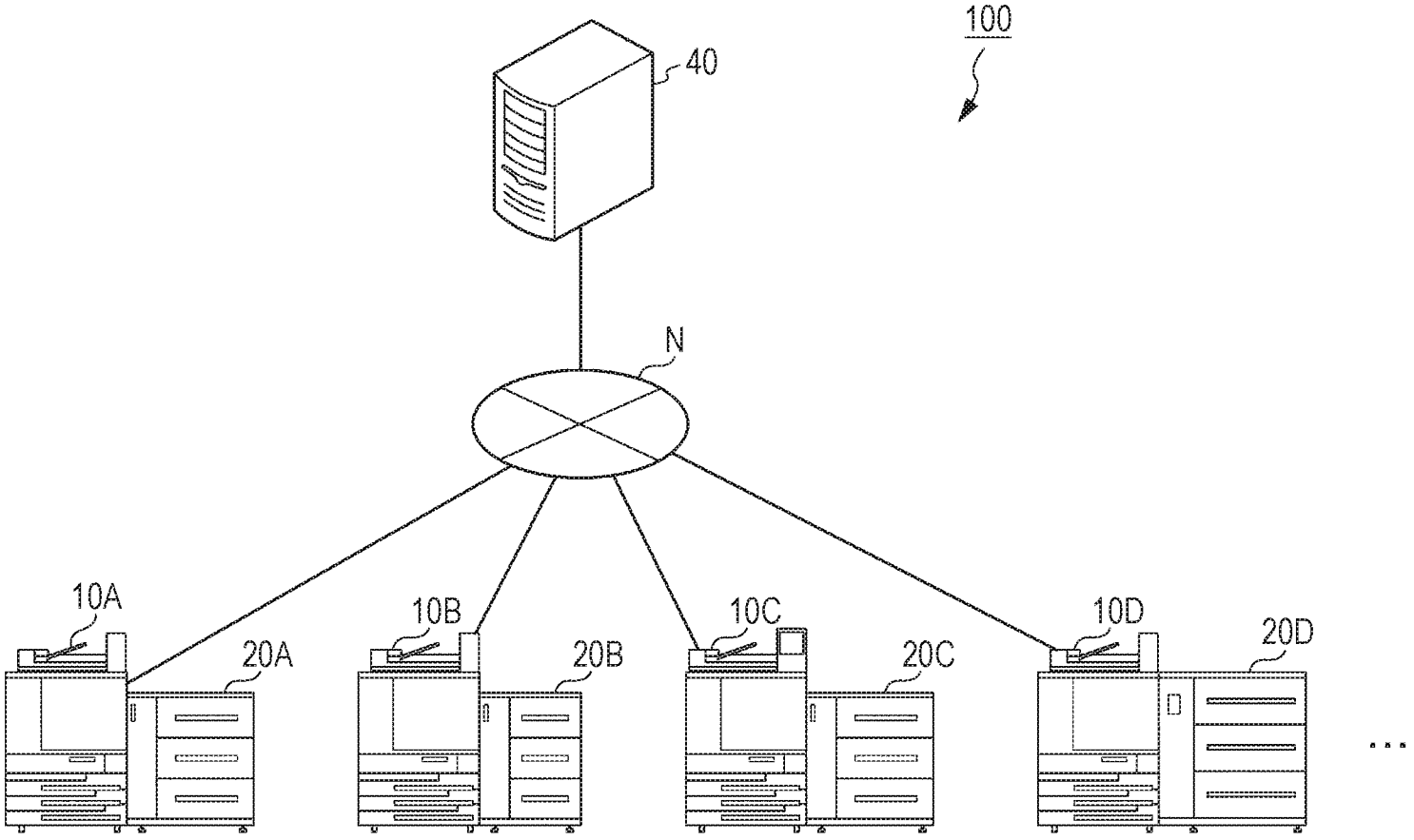
FIG. 1 is a system configuration diagram of a sheet feeding parameter management system in a first embodiment of the present invention.

FIG. 1 illustrates a system configuration of a sheet feeding parameter management system 100 in the first embodiment. In the sheet feeding parameter management system 100, a plurality of image forming apparatuses 10A, 10B, 10C, 10D, . . . and a management apparatus 40 are connected to each other to enable data communication via a communication network N such as the Internet and a local area network (LAN). The image forming apparatuses 10A, 10B, 10C, 10D, . . . are provided with air sheet feeding apparatuses 20A, 20B, 20C, 20D, . . . , respectively. Hereinafter, when not being distinguished, the image forming apparatuses 10A, 10B, 10C, 10D, . . . , and the sheet feeding apparatuses 20A, 20B, 20C, 20D, . . . are referred to as the image forming apparatus 10 and the sheet feeding apparatus 20, respectively.

Figure 2:
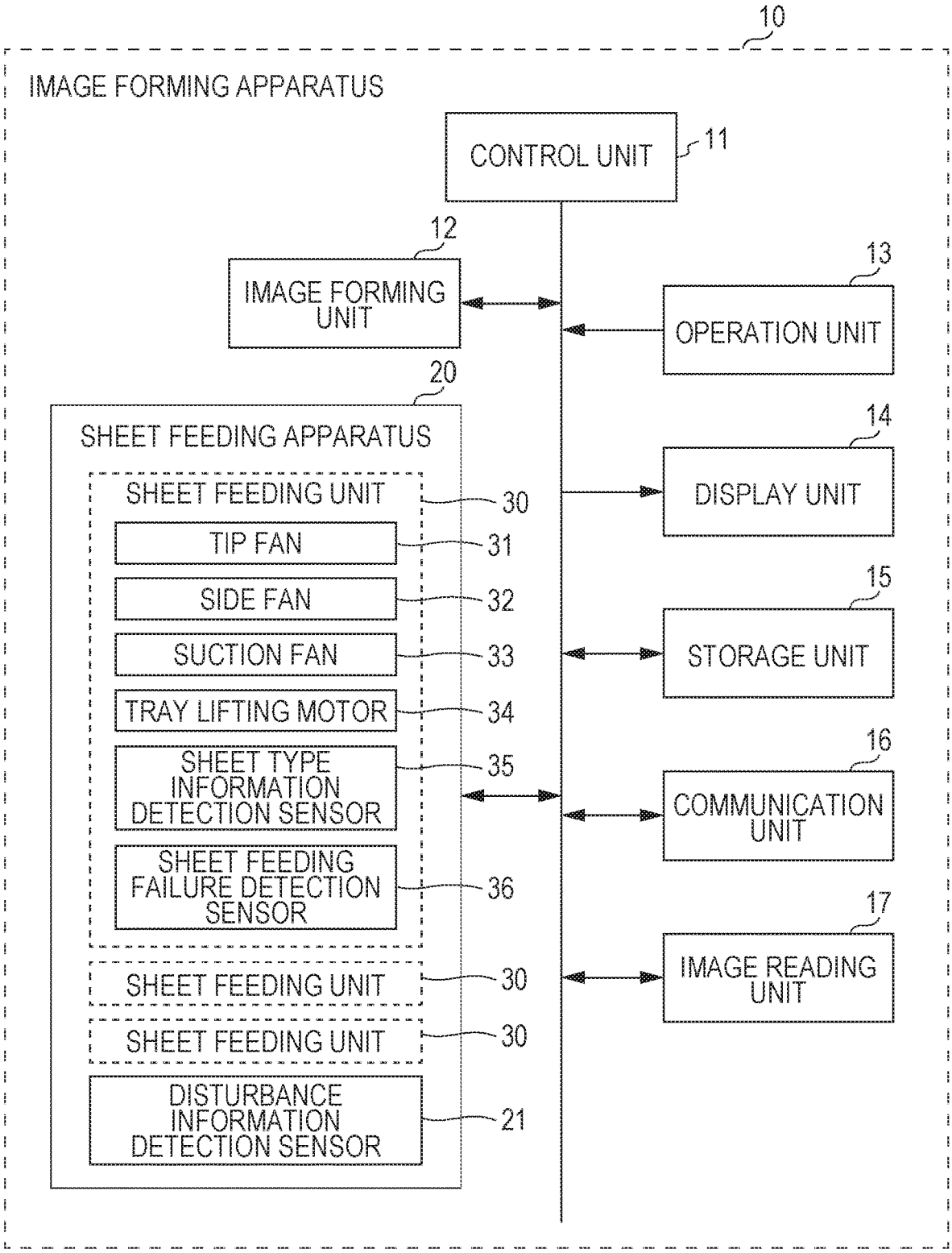
FIG. 2 is a block diagram illustrating a functional configuration of an image forming apparatus.

FIG. 2 illustrates a functional configuration of the image forming apparatus 10. The image forming apparatus 10 includes a control unit 11, an image forming unit 12, the sheet feeding apparatus 20, an operation unit 13, a display unit 14, a storage unit 15, a communication unit 16, and an image reading unit 17, and the units are connected to each other by a bus.

The control unit 11 includes a central processing unit (CPU), random access memory (RAM), and read only memory (ROM), and comprehensively controls processing operation of each unit of the image forming apparatus 10. The CPU reads various processing programs stored in the ROM and deploys the programs on the RAM, and executes various types of processing in accordance with the programs deployed.

The image forming unit 12 forms an image on a sheet supplied from the sheet feeding apparatus 20, based on image data read by the image reading unit 17 or image data received from an external apparatus by the communication unit 16. For example, the image forming unit 12 performs image formation by an electrophotographic system with toner of each color of yellow, magenta, cyan, and black.

The sheet feeding apparatus 20 includes one or more sheet feeding units 30, and a disturbance information detection sensor 21.

Each sheet feeding unit 30 is an air sheet feeder that feeds the sheet by blowing and suctioning to the sheet. The sheet feeding unit 30 includes a tip fan 31, a side fan 32, a suction fan 33, a tray lifting motor 34, a sheet type information detection sensor 35, and a sheet feeding failure detection sensor 36.

Figure 3:
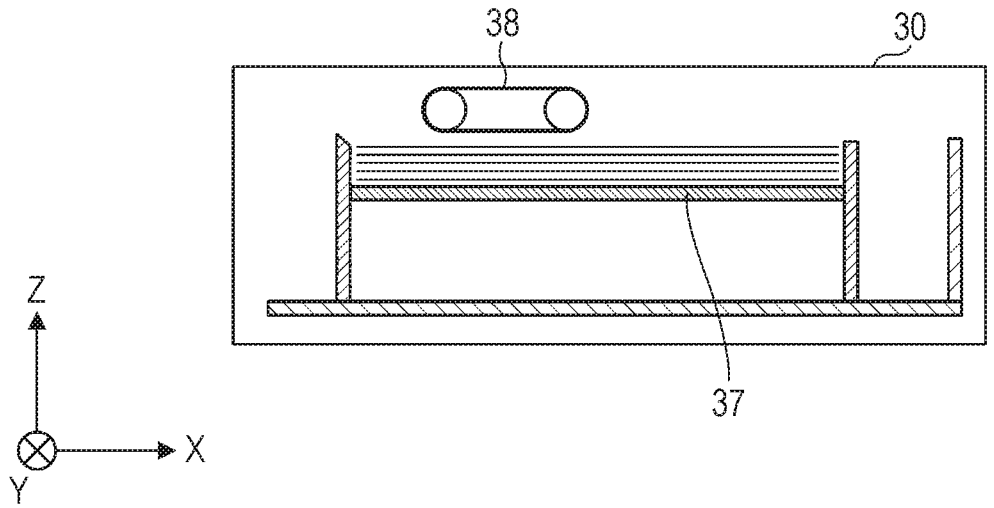
FIG. 3 is a schematic diagram illustrating a cross-sectional configuration along a sheet feeding direction of a sheet feeding unit.

FIG. 3 is a schematic diagram illustrating a cross-sectional configuration along a sheet feeding direction of the sheet feeding unit 30. The sheet feeding unit 30 includes a lifting tray 37, and a sheet feeding belt 38. The sheets stacked on the lifting tray 37 are suctioned and conveyed by the sheet feeding belt 38 and are fed one by one leftward in the X direction illustrated in FIG. 3.

The tip fan 31 blows air to the sheet from the tip side in the sheet feeding direction of the sheet bundle stacked on the lifting tray 37 to separate the uppermost sheet. That is, the tip fan 31 performs air blowing from the tip side in the sheet feeding direction of the sheet bundle rightward in the X direction illustrated in FIG. 3.

The side fan 32 blows air to the sheet from both sides of the sheet edge portion in a direction perpendicular to the sheet feeding direction of the sheet bundle stacked on the lifting tray 37, and causes the uppermost sheet to float. That is, the side fan 32 performs air blowing from both sides in the sheet width direction of the sheet bundle to both directions in the Y direction illustrated in FIG. 3 (from the front side to the back side, and from the back side to the front side with respect to the page surface of FIG. 3).

The suction fan 33 inhales air from a vent hole formed in the sheet feeding belt 38 to cause the sheet feeding belt 38 to suction the sheet. That is, the suction fan 33 causes the sheet to be suctioned upward in the Z direction illustrated in FIG. 3.

The tray lifting motor 34 moves the lifting tray 37 in the Z direction (the vertical direction, the stacking direction of the sheets) illustrated in FIG. 3 to adjust the position of the sheets stacked in the tray.

The sheet type information detection sensor 35 is a device that detects sheet type information from the sheet to be fed in the sheet feeding unit 30, and outputs the detected sheet type information to the control unit 11. That is, the sheet type information detection sensor 35 is a sheet type information acquisitor that acquires the sheet type information of the sheet to be fed. The sheet type information detection sensor 35 includes a reflective photoelectric sensor, and a thickness detection sensor. The sheet type information detection sensor 35 may be provided in the tray of the sheet feeding unit 30, or may be provided on a conveying path of the sheet. The sheet type information includes the surface property, basis weight, stiffness, and size of the sheet.

The sheet feeding failure detection sensor 36 detects sheet feeding failures such as the double feed, sheet skew, and jam in the sheet feeding unit 30, and outputs a detection result to the control unit 11.

The disturbance information detection sensor 21 detects disturbance information, and outputs the detected disturbance information to the control unit 11. The disturbance information includes environment information indicating the environment in which the image firming apparatus 10 is installed, and use state information indicating the use state of a component of the sheet feeding apparatus 20. As the environment information, temperature, humidity, and the like are used. As the use state information, the time from replacement of the component, the number of fed sheets, and the like are used.

The operation unit 13 includes a touch panel formed to cover a display screen of the display unit 14, and various operation buttons such as a numeric button, and a start button, and outputs an operation signal based on operation of a user to the control unit 11.

The display unit 14 includes a liquid crystal display (LCD), and displays various screens in accordance with instructions of display signals input from the control unit 11.

The storage unit 15 includes a storage apparatus such as a nonvolatile semiconductor memory or a hard disk, and stores data and the like relating to various types of processing.

The communication unit 16 performs transmission and reception of the data with an external apparatus such as the management apparatus 40 connected to the communication network N.

The image reading unit 17 optically scans a document conveyed onto a contact glass from an auto document feeder (ADF) or a document placed on the contact glass, focuses reflected light of light for lighting and scanning from a light source to the document on a light-receiving surface of a charge coupled device (CCD) sensor, reads a document image, performs A/D conversion of the read image, and outputs the obtained image data to the control unit 11.

The control unit 11 is enabled to change a sheet feeding parameter in the sheet feeding unit 30, and controls each unit of the sheet feeding apparatus 20, based on the set sheet feeding parameter. The sheet feeding parameter is a parameter relating to sheet feeding, and includes at least one of an air volume of the fan (the tip fan 31, the side fan 32) used for air blowing, an air volume of the fan (suction fan 33) used for suctioning, and a lifting position of the tray (lifting tray 37) on which the sheets are stacked.

The control unit 11 adjusts the sheet feeding parameter in the sheet feeding unit 30, based on operation of the user from the operation unit 13. That is, the control unit 11 functions as an adjuster.

The control unit 11 transmits the sheet type information acquired by the sheet type information detection sensor 35 and the adjusted sheet feeding parameter to the management apparatus 40 via the communication unit 16. That is, the control unit 11 and the communication unit 16 function as a transmitter. Specifically, the control unit 11 transmits the sheet type information and the sheet feeding parameter to the management apparatus 40 at a timing when a sheet feeding failure is detected by the sheet feeding failure detection sensor 36.

The control unit 11 transmits the disturbance information indicating the environment in which the image forming apparatus 10 (the sheet feeding apparatus 20) is installed or the use state of the component of the sheet feeding unit 30 of the sheet feeding apparatus 20 together with the sheet type information and the sheet feeding parameter, to the management apparatus 40 via the communication unit 16.

The control unit 11 transmits model information of the sheet feeding apparatus 20, and model information of the image forming apparatus 10 to which the sheet feeding apparatus 20 is connected (the image forming apparatus 10 including the sheet feeding apparatus 20) together with the sheet type information and the sheet feeding parameter, to the management apparatus 40 via the communication unit 16. Even when the model of the sheet feeding apparatus 20 is the same, when the model of the main body of the image forming apparatus 10 is different, since the sheet interval is different depending on the sheet conveying line speed and the like, an appropriate sheet feeding parameter may be different.

Figure 4:
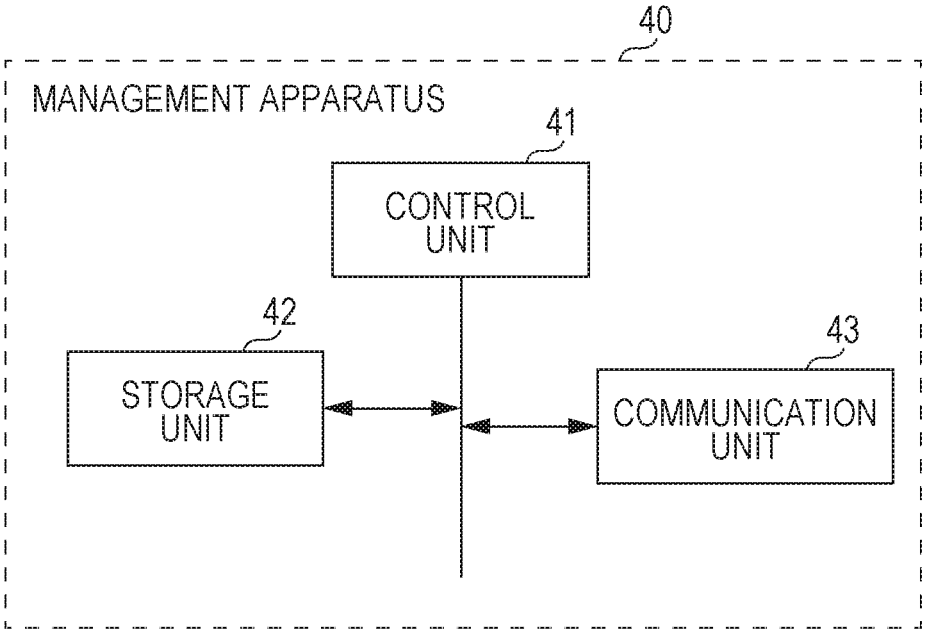
FIG. 4 is a block diagram illustrating a functional configuration of a management apparatus.

FIG. 4 illustrates a functional configuration of the management apparatus 40. The management apparatus 40 includes a control unit 41, a storage unit 42, and a communication unit 43, and the units are connected to each other by a bus. The management apparatus 40 collects and accumulates sheet feeding parameters in the plurality of image forming apparatuses 10 (sheet feeding apparatuses 20) and provides the parameters to each image forming apparatus 10 (sheet feeding apparatus 20).

The control unit 41 includes a CPU, ROM, and RAM, and comprehensively controls processing operation of each unit of the management apparatus 40. The CPU reads various processing programs stored in the ROM and deploys the programs on the RAM, and executes various types of processing in accordance with the programs deployed.

The storage unit 42 includes a storage apparatus such as a nonvolatile semiconductor memory or a hard disk, and stores data and the like relating to various types of processing.

The communication unit 43 performs transmission and reception of the data with an external apparatus such as the image forming apparatus 10 connected to the communication network N.

The control unit 41 causes the storage unit 42 to store an adjustment result associated with the sheet type information and the sheet feeding parameter transmitted from each of the plurality of image forming apparatuses 10. That is, the control unit 41 functions as a parameter manager. Specifically, the control unit 41 updates a table indicating a correspondence relationship between the sheet type information and the sheet feeding parameter in the adjustment result.

The control unit 41 updates the adjustment result, based on the disturbance information transmitted from each image forming apparatus 10.

The control unit 41 updates the correspondence relationship between the sheet type information and the sheet feeding parameter in the adjustment result when the disturbance information is within a predetermined range, and causes the sheet type information and the sheet feeding parameter transmitted together with the disturbance information to be stored in association with the disturbance information when the disturbance information is not within the predetermined range. Hereinafter, the predetermined range is referred to as a reference range.

The control unit 41 updates the adjustment result, based on the model information transmitted from each image forming apparatus 10. Specifically, the control unit 41 causes the sheet type information and the sheet feeding parameter transmitted together with the model information to be stored in association with the model information.

The control unit 41 learns the correspondence relationship between the sheet type information and the sheet feeding parameter in the adjustment result. That is, the control unit 41 functions as a learner. Specifically, the control unit 41 accumulates a newly adjusted sheet feeding parameter in the table in association with the sheet type information.

Based on the adjustment result stored in the storage unit 42, the control unit 41 sets, for an image forming apparatus 10 to be processed among the plurality of image forming apparatuses 10, the sheet feeding parameter corresponding to the sheet type information acquired in the image forming apparatus 10 to be processed. That is, the control unit 41 functions as a setter.

The control unit 41 sets, for an image forming apparatus 10 making a request for the sheet feeding parameter among the plurality of image forming apparatuses 10, the sheet feeding parameter corresponding to the sheet type information acquired by the image forming apparatus 10.

The control unit 41 sets the adjustment result as a learning result obtained by learning for each of the plurality of image forming apparatuses 10. For example, the control unit 41 may distribute on a regular basis the learning result (adjustment result) obtained by learning based on the data collected from the plurality of image forming apparatuses 10 to each image forming apparatus 10.

Next, specific examples will be described of the tables managed in the image forming apparatus 10 and the management apparatus 40.

FIGS. 5A to 5D illustrate data configuration examples of sheet feeding parameter tables Ta, Tb, Tc, and Td stored in the storage unit 15 of the image forming apparatuses 10A, 10B, 10C, and 10D. In the sheet feeding parameter tables Ta, Tb, Tc, and Td, the sheet type information, the sheet feeding parameter, and the disturbance information are stored in association with each other. In the sheet feeding parameter tables Ta, Tb, Tc, and Td, sheet feeding parameters E0, F0, G0, and H0 are stored in advance in association with sheet type information A0, B0, C0, and D0, respectively.

As illustrated in FIG. 5B, it is assumed that in the image forming apparatus 10B, a sheet feeding parameter E1 is obtained for sheet type information A1 by adjustment by the user, and disturbance information at this time is a reference value. The control unit 11 of the image forming apparatus 10B updates the sheet feeding parameter table Tb by adding a correspondence relationship between the sheet type information A1, the sheet feeding parameter E1, and the disturbance information (0). The control unit 11 of the image forming apparatus 10B transmits the sheet type information A1, the sheet feeding parameter E1, the disturbance information (0), and its model information in association with each other to the management apparatus 40 via the communication unit 16.

As illustrated in FIG. 5C, it is assumed that in the image forming apparatus 10C, a sheet feeding parameter F1 is obtained for sheet type information B1 by adjustment by the user, and disturbance information at this time is the reference value. The control unit 11 of the image forming apparatus 10C updates the sheet feeding parameter table Tc by adding a correspondence relationship between the sheet type information B1, the sheet feeding parameter F1, and the disturbance information (0), The control unit 11 of the image forming apparatus 10C transmits the sheet type information B1, the sheet feeding parameter F1, the disturbance information (0), and its model information in association with each other to the management apparatus 40 via the communication unit 16.

As illustrated in FIG. 5D, it is assumed that in the image forming apparatus 10D, a sheet feeding parameter E2 is obtained for the sheet type information A1 by adjustment by the user, and disturbance information at this time is V1. The control unit 11 of the image forming apparatus 10D updates the sheet feeding parameter table Td by adding a correspondence relationship between the sheet type information A1, the sheet feeding parameter E2, and the disturbance information V1. The control unit 11 of the image forming apparatus 10D transmits the sheet type information A1, the sheet feeding parameter E2, the disturbance information V1, and its model information in association with each other to the management apparatus 40 via the communication unit 16.

As illustrated in FIG. 5D, it is assumed that in the image forming apparatus 10D, a sheet feeding parameter F2 is obtained for the sheet type information B1 by adjustment by the user, and disturbance information at this time is the reference value. The control unit 11 of the image forming apparatus 10D updates the sheet feeding parameter table Td by adding a correspondence relationship between the sheet type information B1, the sheet feeding parameter F2, and the disturbance information (0). The control unit 11 of the image forming apparatus 10D transmits the sheet type information B1, the sheet feeding parameter F2, the disturbance information (0), and its model information in association with each other to the management apparatus 40 via the communication unit 16.

FIG. 6A illustrates a data configuration example of a within-reference-range table T1 stored in the storage unit 42 of the management apparatus 40. In the within-reference-range table T1, the sheet type information, the sheet feeding parameter, and the model information are stored in association with each other.

The control unit 41 stores the sheet type information A1, the sheet feeding parameter E1, and the model information of the image forming apparatus 10B (described as "10B" in FIG. 6A. The same shall apply hereinafter.) transmitted from the image forming apparatus 10B in association with each other in the within-reference-range table T1.

Based on the sheet type information B1 and the sheet feeding parameter F1 transmitted from the image forming apparatus 10C, and the sheet type information B1 and the sheet feeding parameter F2 transmitted from the image forming apparatus 10D, the control unit 41 obtains an average value F3 of F1 and F2, and stores the sheet type information B1 and the sheet feeding parameter F3 in association with each other in the within-reference-range table T1. In a model information field, the model information of the image forming apparatus 10C and the model information of the image forming apparatus 10D are stored.

FIG. 6B illustrates a data configuration example of a disturbance adjustment table T2 stored in the storage unit 42 of the management apparatus 40. In the disturbance adjustment table T2, the sheet type information, the disturbance information, a sheet feeding parameter difference, and the model information are stored in association with each other.

When receiving the sheet type information A1, the sheet feeding parameter E2, and the disturbance information V1 from the image forming apparatus 10D, the control unit 41 refers to a record corresponding to the sheet type information A1 of the within-reference-range table T1 illustrated in FIG. 6A, and obtains a difference $\Delta W1=E2-E1$ between the sheet feeding parameter E2 received from the image forming apparatus 10D and the sheet feeding parameter E1 corresponding to the sheet type information A1 of the within-reference-range table T1. Then, the control unit 41 stores the sheet type information A1, the disturbance information V1, the sheet feeding parameter difference $\Delta W1$, and the model information of the image forming apparatus 10D in association with each other in the disturbance adjustment table T2.

Next, operation will be described in the sheet feeding parameter management system 100.

Figure 7:
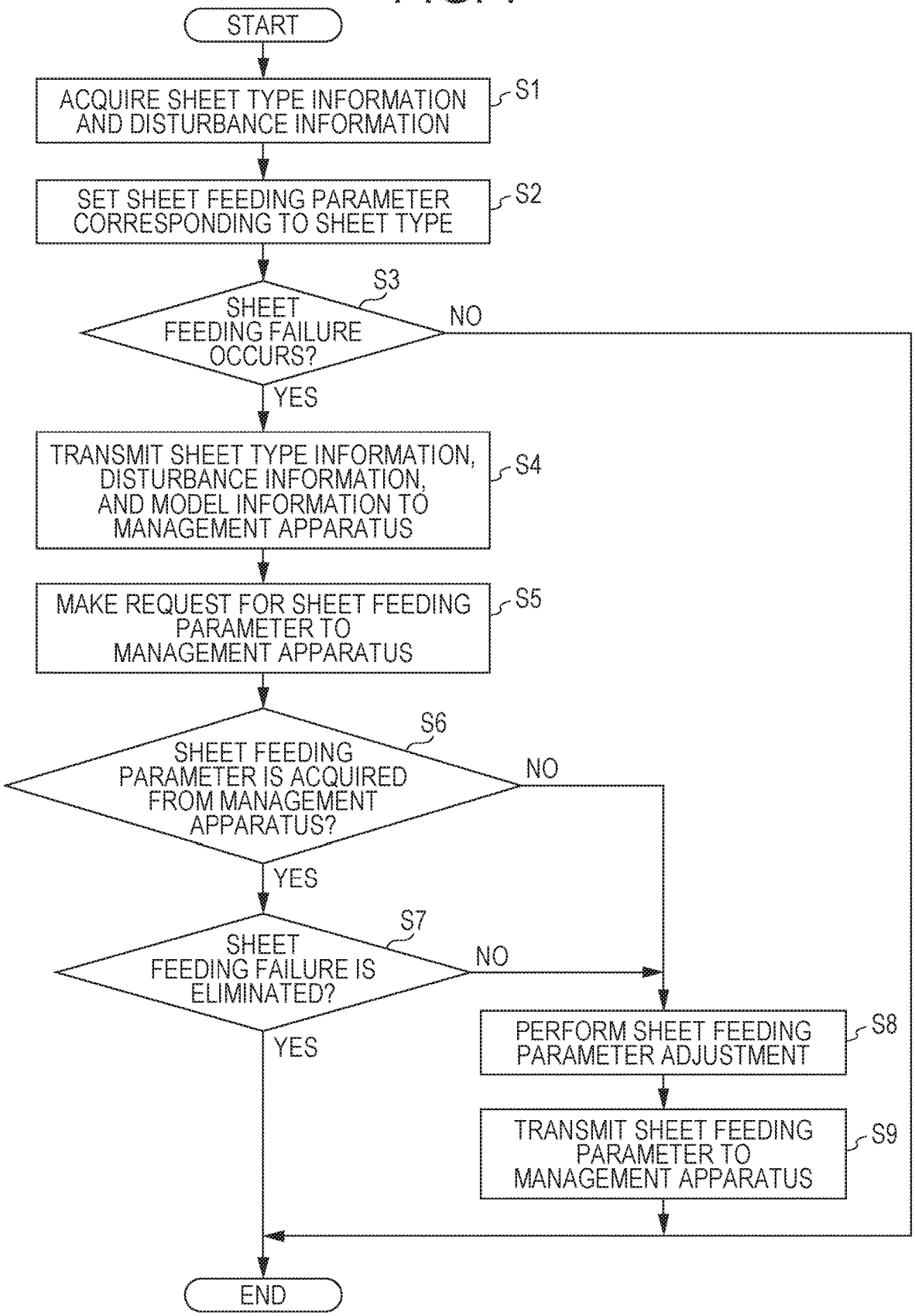
FIG. 7 is a flowchart illustrating processing executed in the image forming apparatus.

FIG. 7 is a flowchart illustrating processing executed in the image forming apparatus 10. This processing is implemented by software processing by cooperation of the CPU of the control unit 11 and the programs stored in the ROM.

First, the control unit 11 acquires the sheet type information of the sheet to be fed detected by the sheet type information detection sensor 35, and the disturbance information (environment information, use state information, and the like) detected by the disturbance information detection sensor 21 (step S1).

Next, the control unit 11 reads, from the sheet feeding parameter table (see FIGS. 5A to 5D) stored in the storage unit 15, the sheet feeding parameter corresponding to the sheet type indicated by the acquired sheet type information, and sets the read sheet feeding parameter (step S2). When there is no corresponding data in the sheet feeding parameter table, the control unit 11 sets a predetermined sheet feeding parameter.

Here, the control unit 11 causes the sheet feeding unit 30 of the sheet feeding apparatus 20 to perform sheet feeding using the set sheet feeding parameter. At this time, the control unit 11 determines whether or not occurrence of a sheet feeding failure is detected by the sheet feeding failure detection sensor 36 (step S3).

When the occurrence of the sheet feeding failure is detected (step S3; YES), the control unit 11 transmits the sheet type information, disturbance information, and model information acquired in step S1 to the management apparatus 40 via the communication unit 16 (step S4). The model information includes the model information of the image forming apparatus 10 and the model information of the sheet feeding apparatus 20. In addition, version information may be included in the model information.

Next, the control unit 11 makes a request for the sheet feeding parameter to the management apparatus 40 via the communication unit 16 (step S5).

Next, in response to the request for the sheet feeding parameter to the management apparatus 40, the control unit 11 determines whether or not the sheet feeding parameter is acquired from the management apparatus 40 via the communication unit 16 (step S6).

When the sheet feeding parameter is acquired from the management apparatus 40 (step S6; YES), the control unit 11 sets the sheet feeding parameter acquired from the management apparatus 40.

Here, the control unit 11 causes the sheet feeding unit 30 of the sheet feeding apparatus 20 to perform sheet feeding using the set sheet feeding parameter, and determines whether or not the sheet feeding failure is eliminated (step S7). When the occurrence of the sheet feeding failure is not detected by the sheet feeding failure detection sensor 36, the control unit 11 determines that the sheet feeding failure is eliminated.

When the sheet feeding parameter is not acquired from the management apparatus 40 in step S6 (step S6; NO), that is, when there is no corresponding data in the management apparatus 40, or when the sheet feeding failure is not eliminated in step S7 (step S7; NO), the control unit 11 performs adjustment of the sheet feeding parameter (step S8). Specifically, the control unit 11 changes setting values for various sheet feeding parameters adjusted by the user from the operation unit 13. For example, the air volume of the tip fan 31, the air volume of the side fan 32, the air volume of the suction fan 33, and the lifting position of the lifting tray 37 are adjusted. The control unit 11 registers the changed sheet feeding parameter in the sheet feeding parameter table of the storage unit 15 in association with the sheet type information and the disturbance information.

Alter step S8, the control unit 11 transmits the adjusted sheet feeding parameter to the management apparatus 40 via the communication unit 16 (step S9). Note that, the sheet type information, disturbance information, and model information transmitted in step S4 may be transmitted again together with the sheet feeding parameter.

When the occurrence of the sheet feeding failure is not detected in step S3 (step S3; NO), when the sheet feeding failure is eliminated in step S7 (step S7; YES), or after step S9, the processing is ended in the image forming apparatus 10.

Figure 8:
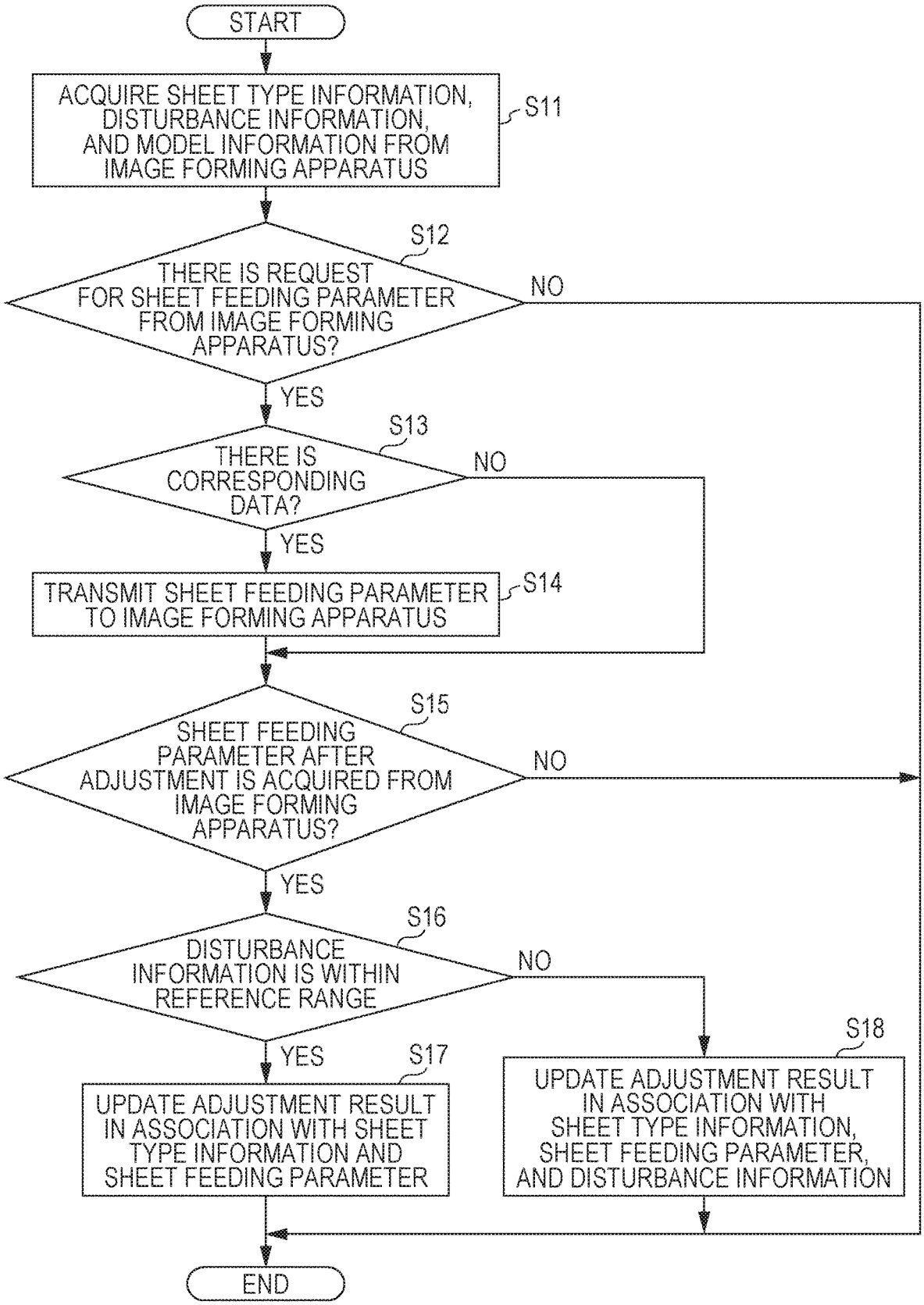
FIG. 8 is a flowchart illustrating processing executed in the management apparatus.

FIG. 8 is a flowchart illustrating processing executed in the management apparatus 40. This processing is implemented by software processing by cooperation of the CPU of the control unit 41 and the programs stored in the ROM.

First, the control unit 41 acquires the sheet type information, the disturbance information, and the model information from any of the image forming apparatuses 10 via the communication, unit 43 (step S11).

Next, the control unit 41 determines whether or not there is a request for the sheet feeding parameter from the image forming apparatus 10 (step S12).

When there is the request for the sheet feeding parameter from the image forming apparatus 10 (step S12; YES), the control unit 41 refers to the within-reference-range table T1 and the disturbance adjustment table T2 stored in the storage unit 42, and determines whether or not there is data corresponding to the acquired sheet type information, disturbance information, and model information (step S13). Note that, the model information may be excluded from an extraction condition, and data obtained in another model may be used.

When there is the corresponding data (step S13; YES), the control unit 41 reads the sheet feeding parameter corresponding to the sheet type information, disturbance information, and model information from the within-reference-range table T1 and the disturbance adjustment table T2, and transmits the read sheet feeding parameter to the image forming apparatus 10 making the request via the communication unit 43 (step S14).

Specifically, when the disturbance information is within the reference range, the control unit 41 acquires the sheet feeding parameter corresponding to the sheet type information and model information from the within-reference-range table T1, and provides the information to the image forming apparatus 10 making the request.

On the other hand, when the disturbance information is not within the reference range, the control unit 41 acquires the sheet feeding parameter difference corresponding to the sheet type information, disturbance information, and model information from the disturbance adjustment table T2, and also acquires the sheet feeding parameter corresponding to the sheet type information from the within-reference-range table T1. Then, the control unit 41 provides a sheet feeding parameter obtained by adding the sheet feeding parameter difference acquired from the disturbance adjustment table T2 to the sheet feeding parameter acquired from the within-reference-range table T1, to the image forming apparatus 10 making the request.

When there is no corresponding data in step S13 (step S13; NO), or after step S14, the control unit 41 determines whether or not the sheet feeding parameter after adjustment is acquired from the image forming apparatus 10 via the communication unit 43 (step S15).

When the sheet feeding parameter after adjustment is acquired from the image forming apparatus 10 (step S15; YES), the control unit 41 determines whether or not the disturbance information acquired in step S11 is within the reference range (step S16).

When the disturbance information is within the reference range (step S16; YES), the control unit 41 updates the adjustment result in association with the sheet type information acquired in step S11 and the sheet feeding parameter acquired in step S15 (step S17). Specifically, the control unit 41 registers the sheet type information, sheet feeding parameter, and model information in association with each other in the within-reference-range table T1 of the storage unit 42.

When the disturbance information is not within the reference range in step S16 (step S16; NO), the control unit 41 updates the adjustment result in association with the sheet type information acquired in step S11, the sheet feeding parameter acquired in step S15, and the disturbance information acquired in step S11 (step S18). Specifically, the control unit 41 registers the sheet type information, disturbance information, sheet feeding parameter difference (difference from when there is no disturbance), and model information in association with each other in the disturbance adjustment table T2 of the storage unit 42.

When there is no request for sheet feeding parameter from the image forming apparatus 10 in step S12 (step S12; NO), when the sheet feeding parameter after adjustment is not acquired from the image forming apparatus 10 in step S15 (step S15; NO), or after step S17 or step S18, the processing is ended in the management apparatus 40.

As described above, according to the first embodiment, the management apparatus 40 collects the adjustment result associated with the sheet type information and sheet feeding parameter transmitted from the plurality of image forming apparatuses 10 (sheet feeding apparatuses 20), whereby the sheet feeding parameter can be shared among the image forming apparatuses 10 (sheet feeding apparatuses 20), and sheet feeding parameters can be set suitable for various sheet types. Every time the management apparatus 40 acquires the sheet type information and the sheet feeding parameter from the image forming apparatus 10, the within-reference-range table T1 and the disturbance adjustment table T2 are updated, so that information on the available sheet type can be increased. In addition, regarding the sheet feeding parameter for the same sheet type information, the average value is registered, whereby accuracy of the within-reference-range table T1 can, be improved.

The adjustment result is updated in consideration of the disturbance information such as the environment information and the use state information, so that data acquired under special circumstances can also be accumulated. Since the suitable sheet feeding parameter is different depending on the temperature, the humidity, and whether or not the sheet is new, it is important to collect the disturbance information together with the sheet type information and the sheet feeding parameter.

For example, when the disturbance information is within the reference range, the correspondence relationship is updated between the sheet type information and the sheet feeding parameter in the adjustment result, and when the disturbance information is not within the reference range, the sheet type information and the sheet feeding parameter (sheet feeding parameter difference) transmitted together with the disturbance information are stored in association with the disturbance information, so that it is possible to collect the adjustment result not including the influence of the disturbance, and the information including the influence of the disturbance. Specifically; the sheet feeding parameter excluding the influence of the disturbance is calculated in the management apparatus 40, whereby a highly accurate sheet feeding parameter can be shared.

The model information is collected of the sheet feeding apparatus 20 or the image forming apparatus 10 whose sheet feeding parameter is adjusted, together with the sheet type information and the sheet feeding parameter, whereby it is also adaptable to a case where the tendency of the sheet feeding parameter is different depending on the model. Specifically, the information can be used obtained in the sheet feeding apparatus 20 or the image forming apparatus 10 of the same model.

The sheet type information and the adjusted sheet feeding parameter are transmitted to the management apparatus 40 at the timing when the sheet feeding failure is detected in the image forming apparatus 10 (the sheet feeding apparatus 20), so that data can be collected in a case where there is a problem in sheet feeding under a sheet feeding condition prepared in advance.

In addition, when the sheet feeding failure occurs, not only the sheet feeding parameter after adjustment but also the sheet feeding parameter used when the sheet feeding failure occurs may be collected as failure data.

Note that, in the first embodiment, in the disturbance adjustment table T2, the sheet feeding parameter difference is stored in association with the disturbance information; however, the sheet feeding parameter may be stored in association with the disturbance information.

In addition, the disturbance information managed in the disturbance adjustment table T2 and the sheet feeding parameter tables Ta, Tb, Tc, and Td may be a difference from the reference value.

Second Embodiment

Next, a second embodiment will be described to which the present invention is applied.

Since the sheet feeding parameter management system in the second embodiment has the same configuration as the sheet feeding parameter management system 100 described in the first embodiment, FIGS. 1 to 4 are cited, and the Illustration and description of its configuration are omitted. Hereinafter, a configuration and processing are described that are characteristic of the second embodiment.

In the second embodiment, in management of a correspondence relationship between the sheet type information and the sheet feeding parameter, an arithmetic expression is used for calculating the sheet feeding parameter from the sheet type information.

The method of transmitting the sheet type information, adjusted sheet feeding parameter, disturbance information, and model information from each image forming apparatus 10 to the management apparatus 40, is the same as in the first embodiment.

The control unit 41 of the management apparatus 40 causes the storage unit 42 to store the sheet type information, sheet feeding parameter, disturbance information, and model information transmitted from each of the plurality of image forming apparatuses 10 in association with each other. Data collected from each image forming apparatus 10 is stored as it is.

The control unit 41 obtains the arithmetic expression for calculating the sheet feeding parameter separately for when the disturbance information is within the reference range and for when the disturbance information is not within the reference range. In the following description, to simplify the explanation, the model information is not considered; however, the arithmetic expression may be obtained for each piece of the model information.

<When the Disturbance Information is within the Reference Range>

As the sheet feeding parameters, a side fan air volume E11, a tip fan air volume E12, and a suction time E13 on the sheet feeding belt 38 are used. In addition, as the sheet type information, a basis weight A11, a surface property A12, and a stiffness A13 are used.

From the correspondence relationship between the sheet type information (A11, A12, and A13) and sheet feeding parameters (E11, E12, and E13) collected from each image forming apparatus 10, the control unit 41 calculates coefficients all, α11, β11, γ11, α12, β12, γ12, α13, β13, and γ13 in the following expressions (1) to (3).

$$E11=\alpha 11\times A11+\beta 11\times A12+\gamma 11\times A13 \quad (1)$$

$$E12=\alpha 12\times A11+\beta 12\times A12+\gamma 12\times A13 \quad (2)$$

$$E13=\alpha 13\times A11+\beta 13\times A12+\gamma 13\times A13 \quad (3)$$

The control unit 41 causes the storage unit 42 to store the arithmetic expressions (1) to (3) including the coefficients α11, β11, γ11, α12, β12, γ12, α13, β13, and γ13 as the adjustment result associated with the sheet type information and the sheet feeding parameters.

When there is a request for the sheet feeding parameters from each image forming apparatus 10, the control unit 41 calculates the sheet feeding parameters (E11, E12, and E13) corresponding to the sheet type information in accordance with the expressions (1) to (3), and sets the calculated sheet feeding parameters for the image forming apparatus 10 making the request.

<When the Disturbance Information is not within the Reference Range>

As the sheet feeding parameters, a side fan air volume E21, a tip fan air volume E22, and a suction time E23 on the sheet feeding belt 38 are used. In addition, as the sheet type information, a basis weight A21, a surface property A22, and a stiffness A23 are used.

From the correspondence relationship between the sheet type information (A21, A22, and A23), sheet feeding parameters (E21, E22, and E23), and disturbance information collected from each image forming apparatus 10, the control unit 41 calculates coefficients α21, β21, γ21, α22, β22, γ22, α23, β23, and γ23, and disturbance offset values δ21, δ22, and δ23 in the following expressions (4) to (6).

$$E21=\alpha 21\times A21+\beta 21\times A22+\gamma 21\times A23+\delta 21 \quad (4)$$

$$E22=\alpha 22\times A21+\beta 22\times A22+\gamma 22\times A23+\delta 22 \quad (5)$$

$$E23=\alpha 22\times A21+\beta 23\times A22+\gamma 23\times A23+\delta 23 \quad (6)$$

The control unit 41 causes the storage unit 42 to stores the arithmetic expressions (4) to (6) including the coefficients α21, β21, γ21, α22, β22, γ22, α23, β23, and γ23, and the disturbance offset values δ21, δ22, and δ23 as the adjustment result associated with the sheet type information and the sheet feeding parameters.

When there is a request for the sheet feeding parameters from each image forming apparatus 10, the control unit 41 calculates the sheet feeding parameters (E21, E22, and E23) corresponding to the sheet type information and disturbance information in accordance with the expressions (4) to (6), and sets the calculated sheet feeding parameters for the image forming apparatus 10 making the request.

The control unit 41 causes the information of newly adjusted sheet feeding parameters and the sheet type information to reflect in the arithmetic expressions, thereby learning the correspondence relationship between the sheet type information and the sheet feeding parameters in the adjustment result.

Next, operation will be described of the sheet feeding parameter management system of the second embodiment.

The processing executed in the image forming apparatus 10 is the same as the processing illustrated in FIG. 7.

As for processing executed by the management apparatus 40, a part will be described different from the processing illustrated in FIG. 8.

When there is a request for the sheet feeding parameters from the image forming apparatus 10 in step S12 (step S12; YES), the control unit 41 calculates the sheet feeding parameters corresponding to the sheet type information in accordance with the arithmetic expressions (1) to (3), or the arithmetic expressions (4) to (6) without making the determination in step S13. Then, the control unit 41 transmits the calculated sheet feeding parameters to the image forming apparatus 10 making the request, via the communication unit 43 (step S14).

Thereafter, when the sheet feeding parameters after adjustment are acquired from the image forming apparatus 10 in step S15 (step S15; YES), the control unit 41 determines whether or not the disturbance information is within the reference range (step S16).

When the disturbance information is within the reference range (step S16; YES), the control unit 41 updates the adjustment result in association with the sheet type information acquired in step S11 and the sheet feeding parameters acquired in step S15 (step S17). Specifically, the control unit 41 recalculates the arithmetic expressions (1) to (3) by adding newly acquired sheet type information and sheet feeding parameters.

When the disturbance information is not within the reference range in step S16 (step S16; NO), the control unit 41 updates the adjustment result in association with the sheet type information acquired in step S11, the sheet feeding parameters acquired in step S15, and the disturbance information acquired in step S11 (step S18). Specifically, the control unit 41 recalculates the arithmetic expressions (4) to (6) by adding newly acquired sheet type information, disturbance information, and sheet feeding parameters.

As described above, according to the second embodiment, similarly to the first embodiment, the management apparatus 40 collects the adjustment result associated with the sheet type information and sheet feeding parameters transmitted from the plurality of image forming apparatuses 10 (sheet feeding apparatuses 20), whereby the sheet feeding parameters can be shared among the image forming apparatuses 10 (sheet feeding apparatuses 20), and sheet feeding parameters can be set suitable for various sheet types. Each time the management apparatus 40 acquires the sheet type information and the sheet feeding parameters from the image forming apparatus 10, the arithmetic expressions are updated, so that accuracy of the sheet feeding parameters can be improved.

The management apparatus 40 obtains the arithmetic expressions, based on the data collected from the plurality of image forming apparatuses 10 (sheet feeding apparatuses 20), whereby the sheet feeding parameters corresponding to the sheet type information can be easily calculated.

Note that, in the second embodiment, the sheet feeding parameters calculated by the management apparatus 40 in accordance with the arithmetic expressions are provided to each image forming apparatus 10 (the sheet feeding apparatus 20); however, the management apparatus 40 may provide the arithmetic expressions to each image forming apparatus 10 (sheet feeding apparatus 20), and the sheet feeding parameters corresponding to the sheet type information may be calculated in the image forming apparatus 10 side.

The description of each of the above embodiments is an example of the sheet feeding parameter management system according to the present invention, and this is not a limitation. The detailed configuration and detailed operation of each apparatus configuring the system can also be modified if appropriate within a range without departing from the spirit of the present invention.

For example, characteristic processing in each of the embodiments may be combined together.

In the above embodiments, the sheet type information of the sheet to be fed is acquired by the sheet type information detection sensor 35; however, the control unit 11 of the image firming apparatus 10 may acquire the sheet type information input from the operation unit 13 by the user.

In the above embodiments, the disturbance information including the environment information is acquired by the disturbance information detection sensor 21; however, the control unit 11 of the image forming apparatus 10 may acquire the environment information from an external apparatus.

In the plurality of image forming apparatuses 10 (sheet feeding apparatuses 20), the sheet feeding parameters may be shared among the apparatuses having the same model information, or the sheet feeding parameters may be shared regardless of the model information.

In each of the above embodiments, the control unit 11 of the image forming apparatus 10 also serves as a control unit that controls each unit of the sheet feeding apparatus 20; however, the sheet feeding apparatus 20 may include a control unit separate from the control unit 11.

In accumulation of the correspondence relationship between the sheet type information and the sheet feeding parameters, the sheet feeding parameters corresponding to the sheet type information may be acquired by machine learning using the sheet type information (if necessary; a combination of sheet type information, disturbance information, and model information) as an input and the sheet feeding parameter as an output.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet feeding parameter management system comprising:

a plurality of air sheet feeding apparatuses each including an air sheet feeder that feeds a sheet by air blowing and suctioning to the sheet and enabled to change a sheet feeding parameter in the air sheet feeder; and a management apparatus connected to the plurality of air sheet feeding apparatuses via a communication network, wherein each of the plurality of air sheet feeding apparatuses includes:

a sheet type information acquisitor that acquires sheet type information of a sheet to be fed; and a first hardware processor that:

adjusts the sheet feeding parameter in the air sheet feeder; and transmits the sheet type information acquired by the sheet type information acquisitor and the sheet feeding parameter adjusted by the first hardware processor to the management apparatus, and wherein the management apparatus includes a second hardware processor that:

causes a storage to store an adjustment result associated with the sheet type information and the sheet feeding parameter transmitted from each of the plurality of air sheet feeding apparatuses; and sets, based on the adjustment result stored in the storage, for an air sheet feeding apparatus to be processed among the plurality of air sheet feeding apparatuses, the sheet feeding parameter corresponding to the sheet type information acquired by the sheet type information acquisitor of the air sheet feeding apparatus to be processed.

2. The sheet feeding parameter management system according to claim 1, wherein:

the first hardware processor of one of the air sheet feeding apparatuses transmits, to the management apparatus, disturbance information indicating an environment in which said one of the air sheet feeding apparatuses including the first hardware processor is installed or a use state of a component of the air sheet feeder of said one of the air sheet feeding apparatuses, together with the sheet type information and the sheet feeding parameter; and the second hardware processor updates the adjustment result, based on the disturbance information transmitted.

3. The sheet feeding parameter management system according to claim 2, wherein the second hardware processor updates a correspondence relationship between the sheet type information and the sheet feeding parameter in the adjustment result when the disturbance information is within a predetermined range, and causes the sheet type information and the sheet feeding parameter, which are transmitted together with the disturbance information, to be registered in association with the disturbance information when the disturbance information is not within the predetermined range.

4. The sheet feeding parameter management system according to claim 1, wherein:

the first hardware processor of one of the air sheet feeding apparatuses transmits, to the management apparatus, model information of said one of the air sheet feeding apparatuses including the first hardware processor or model information of an image forming apparatus to which said one of the air sheet feeding apparatuses is connected, together with the sheet type information and the sheet feeding parameter; and the second hardware processor updates the adjustment result, based on the model information transmitted.

5. The sheet feeding parameter management system according to claim 1, wherein the sheet type information includes a surface property, basis weight, stiffness, or size of a sheet, and the sheet type information acquisitor is a device that detects the sheet type information from the sheet to be fed, or a device that acquires the sheet type information input by a user.

6. The sheet feeding parameter management system according to claim 1, wherein the sheet feeding parameter includes at least one of an air volume of a fan used for air blowing, an air volume of a fan used for suctioning, and a lifting position of a tray on which sheets are stacked.

7. The sheet feeding parameter management system according to claim 1, wherein each of the plurality of air sheet feeding apparatuses includes a detector that detects a sheet feeding failure, and the first hardware processor transmits, to the management apparatus, the sheet type information acquired by the sheet type information acquisitor and the sheet feeding parameter adjusted by the first hardware processor, at a timing when the sheet feeding failure is detected by the detector.

8. The sheet feeding parameter management system according to claim 1, wherein the second hardware processor:

learns a correspondence relationship between the sheet type information and the sheet feeding parameter in the adjustment result; and sets a learning result by the second hardware processor for each of the plurality of air sheet feeding apparatuses.

9. The sheet feeding parameter management system according to claim 1, wherein the second hardware processor sets, for an air sheet feeding apparatus making a request among the plurality of air sheet feeding apparatuses, the sheet feeding parameter corresponding to the sheet type information acquired by the sheet type information acquisitor of the air sheet feeding apparatus making the request.

10. The sheet feeding parameter management system according to claim 1, wherein the second hardware processor updates a table indicating a correspondence relationship between the sheet type information and the sheet feeding parameter in the adjustment result, or an arithmetic expression that calculates the sheet feeding parameter from the sheet type information.

11. A method for a sheet feeding parameter management system comprising (i) a plurality of air sheet feeding apparatuses each including an air sheet feeder that feeds a sheet by air blowing and suctioning to the sheet and enabled to change a sheet feeding parameter in the air sheet feeder; and (ii) a management apparatus connected to the plurality of air sheet feeding apparatuses via a communication network, wherein each of the plurality of air sheet feeding apparatuses further includes a sheet type information acquisitor that acquires sheet type information of a sheet to be fed and a first hardware processor, and wherein the management apparatus includes a second hardware processor, the method comprising:

adjusting, by the first hardware processor, the sheet feeding parameter in the air sheet feeder;

transmitting, by the first hardware processor, the sheet type information acquired by the sheet type information acquisitor and the sheet feeding parameter adjusted by the first hardware processor to the management apparatus;

causing, by the second hardware processor, a storage to store an adjustment result associated with the sheet type information and the sheet feeding parameter transmitted from each of the plurality of air sheet feeding apparatuses; and setting, by the second hardware processor, based on the adjustment result stored in the storage, for an air sheet feeding apparatus to be processed among the plurality of air sheet feeding apparatuses, the sheet feeding parameter corresponding to the sheet type information acquired by the sheet type information acquisitor of the air sheet feeding apparatus to be processed.

* * * * *